US009402491B1

(12) United States Patent
Debernardi

(10) Patent No.: US 9,402,491 B1
(45) Date of Patent: Aug. 2, 2016

(54) PIZZA BOX AND CUP HOLDER IN COMBINATION

(71) Applicant: Dominick Joseph Debernardi, Reno, NV (US)

(72) Inventor: Dominick Joseph Debernardi, Reno, NV (US)

( * ) Notice: Subject to any disclaimer, the term of this patent is extended or adjusted under 35 U.S.C. 154(b) by 0 days.

(21) Appl. No.: 14/999,122

(22) Filed: Mar. 31, 2016

(51) Int. Cl.

| | |
|---|---|
| ***B65D 5/4805*** | (2006.01) |
| ***B65D 5/66*** | (2006.01) |
| ***A47G 19/06*** | (2006.01) |
| ***A47G 21/00*** | (2006.01) |
| ***B65D 5/20*** | (2006.01) |
| ***B65D 5/22*** | (2006.01) |
| ***B65D 5/00*** | (2006.01) |
| ***A47G 23/02*** | (2006.01) |
| ***B65D 5/48*** | (2006.01) |
| *B65D 5/42* | (2006.01) |

(52) U.S. Cl.
CPC ..... *A47G 21/001* (2013.01); *A47G 23/0216* (2013.01); *B65D 5/009* (2013.01); *B65D 5/2009* (2013.01); *B65D 5/22* (2013.01); *B65D 5/4801* (2013.01); *B65D 5/48018* (2013.01); *B65D 5/4266* (2013.01); *B65D 2585/366* (2013.01)

(58) Field of Classification Search
CPC . A47G 21/001; A47G 23/0216; A47G 19/06; B65D 5/2009; B65D 5/4266; B65D 5/48018; B65D 5/4801; B65D 5/6626; B65D 5/6629; B65D 2585/366; B65D 5/009; B65D 5/22
USPC ..... 229/120.03, 120.08, 120.12, 904, 906
See application file for complete search history.

(56) References Cited

U.S. PATENT DOCUMENTS 1,715,782 A * 6/1929 Pickop ..... B65D 7/36 220/616
2,670,124 A * 2/1954 Buchmiller ..... B65D 5/5038 108/46

(Continued)

FOREIGN PATENT DOCUMENTS

FR 2811294 A1 * 1/2002 ..... B65D 5/6629

*Primary Examiner* — Gary Elkins

(57) ABSTRACT

Herein disclosed is a novel and uniquely shaped pizza box and cup holder in combination. In a first embodiment the pizza box is of a shape and size to contain a single slice of pizza and support at least one beverage therein. The pizza box with the beverage is easily carried with one hand and the box when opened is functional as a plate and cup holder. The box may be produced in various sizes of engineering choice. The box is easily made and integrally formed from one piece of material. A further embodiment includes the pizza box being of a shape and size to carry more than one slice of pizza and more than one beverage.

8 Claims, 4 Drawing Sheets

(56) References Cited

U.S. PATENT DOCUMENTS 2,924,372 A * 2/1960 Kirkeby ..... B65D 5/48018 206/563
3,001,684 A * 9/1961 Wenzel ..... B65D 5/4802 206/563
3,366,303 A * 1/1968 Kaspar ..... A47G 23/06 206/427
4,489,879 A * 12/1984 Mode ..... B65D 5/02 206/563
4,497,433 A * 2/1985 Wischusen, III ..... B65D 5/064 206/562
4,511,042 A * 4/1985 Wischusen, III ..... B65D 5/064 206/562
4,572,423 A * 2/1986 Spencer ..... B65D 5/0015 206/509
4,757,937 A * 7/1988 Maio ..... B65D 5/3635 206/562
4,969,595 A * 11/1990 Teasdale ..... B65D 5/422 206/459.5
5,788,081 A * 8/1998 Bates ..... A47G 23/06 206/562
5,890,648 A * 4/1999 Cai ..... B65D 5/48018 229/120.05
6,401,927 B1 * 6/2002 Sorensen ..... A47G 19/06 206/216
6,568,586 B1 * 5/2003 VanEsley ..... B65D 5/2004 206/562
7,007,837 B2 * 3/2006 Correll ..... B65D 5/5021 229/120.05
7,008,656 B2 * 3/2006 Zimmerman, Jr. ..... A47J 36/28 206/217
7,565,997 B1 * 7/2009 Lim ..... B65D 71/72 206/562
7,617,969 B2 * 11/2009 Oliveira ..... B65D 5/46096 206/145
7,631,800 B2 * 12/2009 Cai ..... B65D 5/5021 229/114
7,757,860 B2 * 7/2010 Philips ..... B65D 75/38 206/217
2005/0150938 A1 * 7/2005 Correll ..... B65D 5/5021 229/120.15
2006/0042989 A1 * 3/2006 Suter ..... B65D 5/5007 206/562

* cited by examiner

PIZZA BOX AND CUP HOLDER IN COMBINATION

FIELD OF THE INVENTION

The present invention relates in general to pizza boxes but more particularly pertains to a novel pizza box which is constructed to contain a slice(s) of a pizza, not a complete pizza. The pizza box is also unique as it includes cup holder(s) for supporting a beverage cup therein.

BACKGROUND OF THE INVENTION

Fast food restaurants are extremely popular and utilized throughout the world by patrons. As a result there are numerous types of fast food items, such as hamburgers, hotdogs, fish and chips, etc. However, pizza is an all-time favorite and highly sold and consumed on a daily basis globally. As a result many pizzerias' offer whole pizza's for sale as well as "pizza by the slice". When ordering, the patron may be asked of the pizza is for here or to go. If the pizza is "for here" then the pizza is normally served on a platter or the like. If the pizza is "to go" it is normally given to the patron in a portable food carton such as a typical pizza box. The typical pizza box is functional for a full size pizza and is normally square shaped or the like. However, a patron who wishes for only one slice of pizza is normally given the pizza in a paper bag with the pizza slice being positioned onto a piece of wax paper or the like. This practice is extremely cumbersome and awkward for the patron to carry. The patron must balance and hold the paper bag (with the pizza slice therein) in a horizontal position so as not to deform the pizza. Another disadvantage of this practice is that pizza tends to be very greasy, thus a simple paper bag with wax paper is very inefficient as each tend to absorb the grease and this can be very messy and annoying. Still further most often the patron will have ordered a soft drink or the like. Therefore, the patron must hold the soft drink in one hand and the sliced bagged pizza in the other. Obviously the patron now has both hands full and cannot carry any other items. This is a big problem of which has not been recognized, addressed, nor resolved within the known prior art.

Therefore, there is a need for an easy way to carry a slice(s) of pizza and a beverage simultaneously with one hand. Thus, the present invention is novel and unique and resolves this problem in a manner heretofore not taught.

OBJECTS AND ADVANTAGES OF THE PRESENT INVENTION

It is therefore a primary object of the present invention to solve a problem which has heretofore not been recognized, addressed or resolved. Namely, to provide a simple pizza box of which allows a user to carry a slice(s) of pizza and a beverage(s) simultaneously, with only one hand.

It is another object of the present invention to provide a new and novel pizza box which is integrally made from one piece of material, such as cardboard, Styrofoam' or other suitable material of engineering choice.

A further object of the present invention is to provide a novel pizza box which is easy to manufacture, cost effective and easily marketable.

DETAILED DESCRIPTION OF THE DRAWINGS

Figure 1:
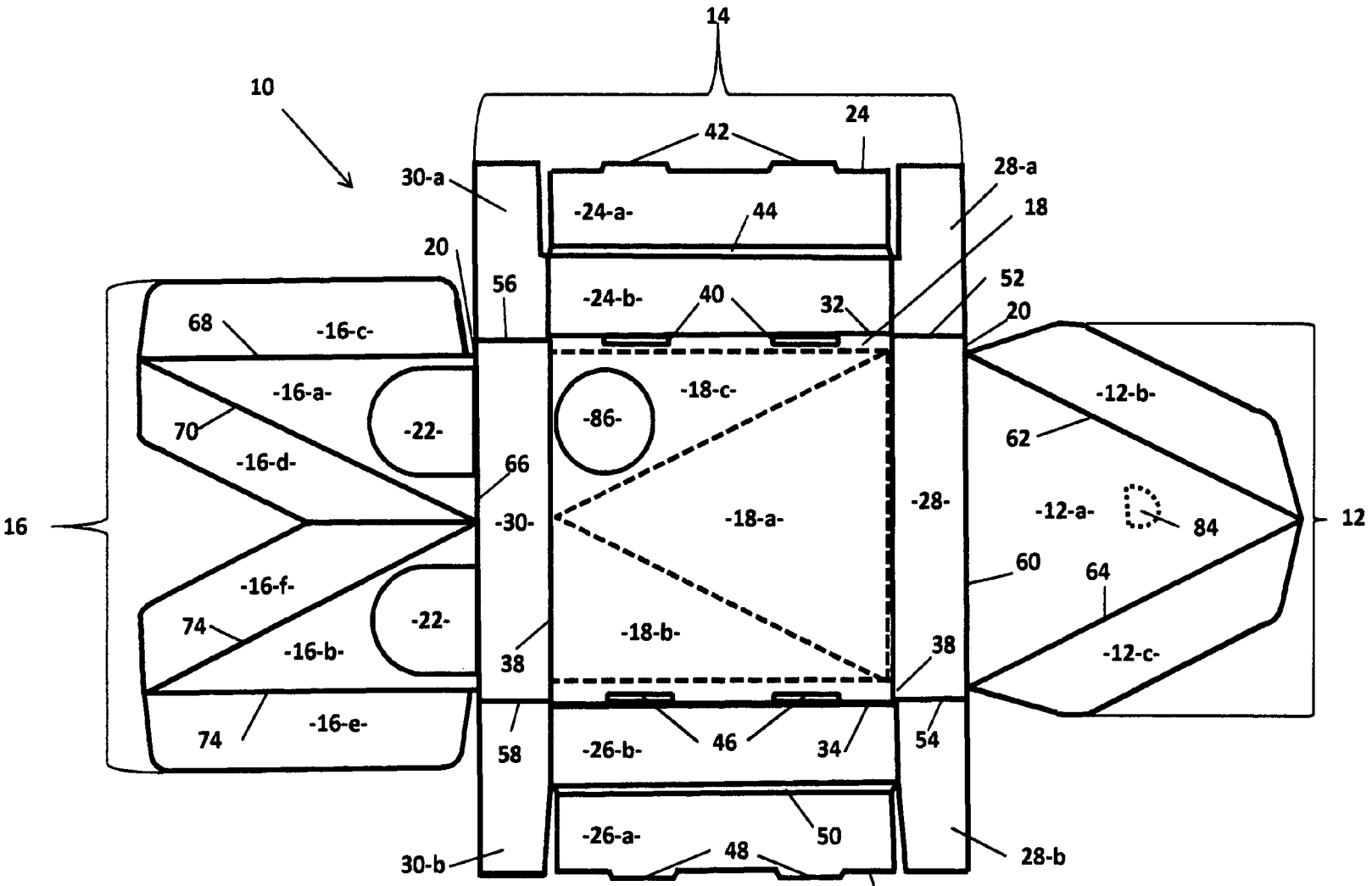
FIG. 1 is a top view of the single slice pizza box with cup holders depicting a first embodiment for the present invention when in an unfolded open position.
Figure 2:
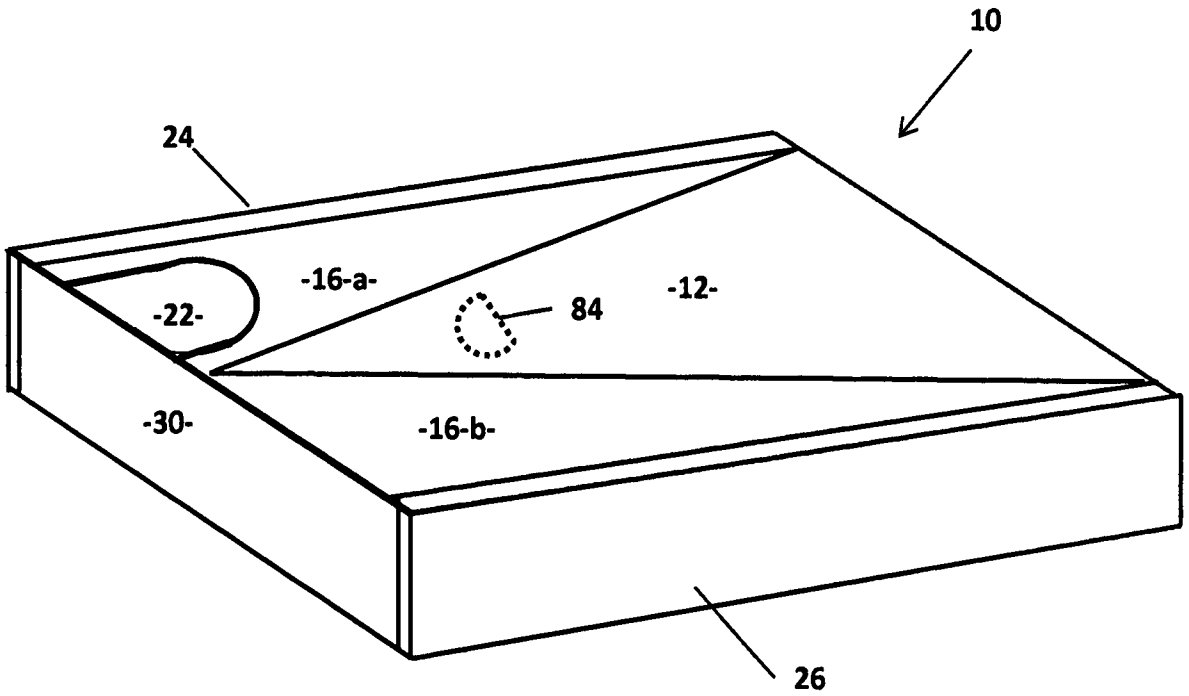
FIG. 2 is a perspective view of the embodiment of figure one depicted in a folded closed position.

Referring now in detail to the drawings wherein like characters refer to like elements throughout the various views. A first embodiment for the present invention is depicted in FIG. 1 wherein (10) is an overview for a pizza box having a drink cup receptacle and a compartment for containment of a single slice of pizza (not shown) in combination comprising of an integrally made pizza box (10) formed from one piece of material, such as cardboard, Styrofoam™ or any other suitable material of engineering choice. The pizza box (10) having a right side section (12), a central section (14), and a left side section (16). The central section (14) when folded provides a bottom (18) with side walls (20) which form the shape of a box. The bottom (18) including a first sector (18-*a*), a second sector (18-*b*) and a third sector (18-*c*), (each sector shown in ghost lines). The first sector (18-*a*) functions as a platform for centrally positioning a single slice of pizza (pizza not shown) onto the bottom (18). The right side section (12) when folded functions as a lid which is of a shape and size to be positioned above the top and around the sides of a single slice of pizza (pizza not shown). The left side section (16) having a first half triangular portion (16-*a*) and a second half triangular portion (16-*b*). The first half triangular portion (16-*a*) when folded functions as a lid for covering the third sector (18-*c*) and the second half triangular portion (16-*b*) functions as a lid for covering the second sector (18-*b*). It is to be noted at least one or both of the half portions (16-*a* or 16-*b*) includes a hole (22) for slideably receiving a drink cup (not shown) there through when in the folded position and at least one or both of the sectors (18-*b* or 18-*c*) function as a support means for supporting the drink cup (not shown) thereon.

The central section (14) further including a first end segment (24), a second end segment (26); a right side segment (28) and a left side segment (30). Each end segment (24 & 26) being opposed to each other yet interconnected by bottom (18). The first end segment (24) being differentiated by a first fold line (32) located between first end segment (24) and the bottom (18). The second end segment (26) being differentiated by a second fold line (34) located between the second end segment (26) and the bottom (18). Each side segment (28 & 30) being opposed to each other yet interconnected by the bottom (18).

The right side segment (28) being differentiated by a third fold line (36) located between the right side segment (28) and the bottom (18). The left side segment (30) being differentiated by a fourth fold line (38) located between the left side segment (30) and the bottom (18). The bottom (18) having a first pair of apertures (40) located adjacent the first fold line (32). The first end segment (24) having a first pair of outwardly projecting tabs (42). The first pair of apertures (40) and the first pair of outwardly projecting tabs (42) being opposed to each other yet interconnected by a first foldable central partition (44) which forms a top half (24-*a*) and a bottom half (24-*b*). The first pair of outwardly projecting tabs (42) being of a shape and size to mate within the first pair of apertures (40) when the first foldable central partition (44) is folded.

The bottom (18) having a second pair of apertures (46) located adjacent the second fold line (34). The second end segment 26) having a second pair of outwardly projecting tabs (48). The second pair of apertures (46) and the second pair of outwardly projecting tabs (48) being opposed to each other yet interconnected by a second foldable central partition (50) which forms a top half (26-*a*) and a bottom half (26-*b*). The second pair of outwardly projecting tabs (48) being of a shape and size to mate within the second pair of apertures (46) when the second foldable central partition (50) is folded.

The right side segment (28) having a right side first end flap (28-*a*) and a right side second end flap (28-*b*) opposed to each other yet interconnected by the right side segment (28). The right side first end flap (28-*a*) being differentiated by a fifth fold line (52) and the right side second end flap (28-*b*) being differentiated by a sixth fold line (54). The left side segment (30) having a left side first end flap (30-*a*) and a left side second end flap (30-*b*) opposed to each other yet interconnected by the left side segment (30) and the left side first end flap (30-*a*) being differentiated by a seventh fold line (56) and the left side second end flap (30-*b*) being differentiated by an eighth fold line (58).

The right side section (12) having a triangular base division (12-*a*), a first elongated flap (12-*b*) and a second elongated flap (12-*c*). The triangular base division (12-*a*) being interconnected to the right side segment (28) yet differentiated by a ninth fold line (60). The first elongated flap (12-*b*) being differentiated from the triangular base division (12-*a*) by a tenth fold line (62) and the second elongated flap (12-*c*) being differentiated from the triangular base division (12-*a*) by an eleventh fold line (64).

The left side section (16) being interconnected to the left side segment (30) yet differentiated by a twelfth fold line (66). The first half triangular portion (16-*a*) of the left side section (16) having an outside elongated flap (16-*c*) differentiated by a thirteenth fold line (68) and the first half triangular portion (16-*a*) having an inner elongated flap (16-*d*) differentiated by a fourteenth fold line (70). The second half triangular portion (16-*b*) of the left side section (16) having an elongated outside flap (16-*e*) differentiated by a fifteenth fold line (72) and the second half triangular portion (16-*b*) of the left side section (16) having an elongated inner flap (16-*f*) differentiated by a sixteenth fold line (74).

Whereby when the central section (14) is folded each first end flap (28-*a* & 30-*a*) of the right segment and said left segment (28 & 30) can be positioned and nested in between the top half (24-*a*) and the bottom half (24-*b*) of the first end segment (24). Each end flap (28-*b* & 30-*b*) of the right side segment and said left segment (28 & 30) can be positioned and nested in between the top half (26-*a*) and the bottom half (26-*b*) of the second end segment (26). The first pair of outwardly projecting tabs (42) (when folded) have a mating relationship within the first pair of apertures (40) and the second pair of outwardly projecting tabs (48) (when folded) have a mating relationship within the second pair of apertures (46). Thus, resulting in the central section (14) forming the bottom (18) and the side walls (20) of the pizza box (10). The right side section (12) when folded encloses the first sector (18-*a*). When the first half portion (16-*a*) is folded encloses the third sector (18-*c*) and the second half portion (16-*b*) when folded encloses the second sector (18-*b*).

The pizza box (10) may include additional options of engineering choice. Such as, the triangular base division (12-*a*) of the right side section (12) further includes a perforated substantially U-shaped finger punch (84) as depicted in FIG. 1. Thus, the user first positions their finger onto the perforated finger punch (84), then presses downward until release of the perforated finger punch (84) and then the user's finger can easily lift the triangular base division (12-*a*), thus, resulting in a convenient means for easily opening the compartment containing the pizza slice.

Another optional feature for the pizza box (10) includes at least one or both of the sectors (18-*c* or 18-*b*) (each of which function as a support means for the drink cup) having at least one or multiple circular indents (86) for supporting different sizes of the drink cup.

Figure 3:
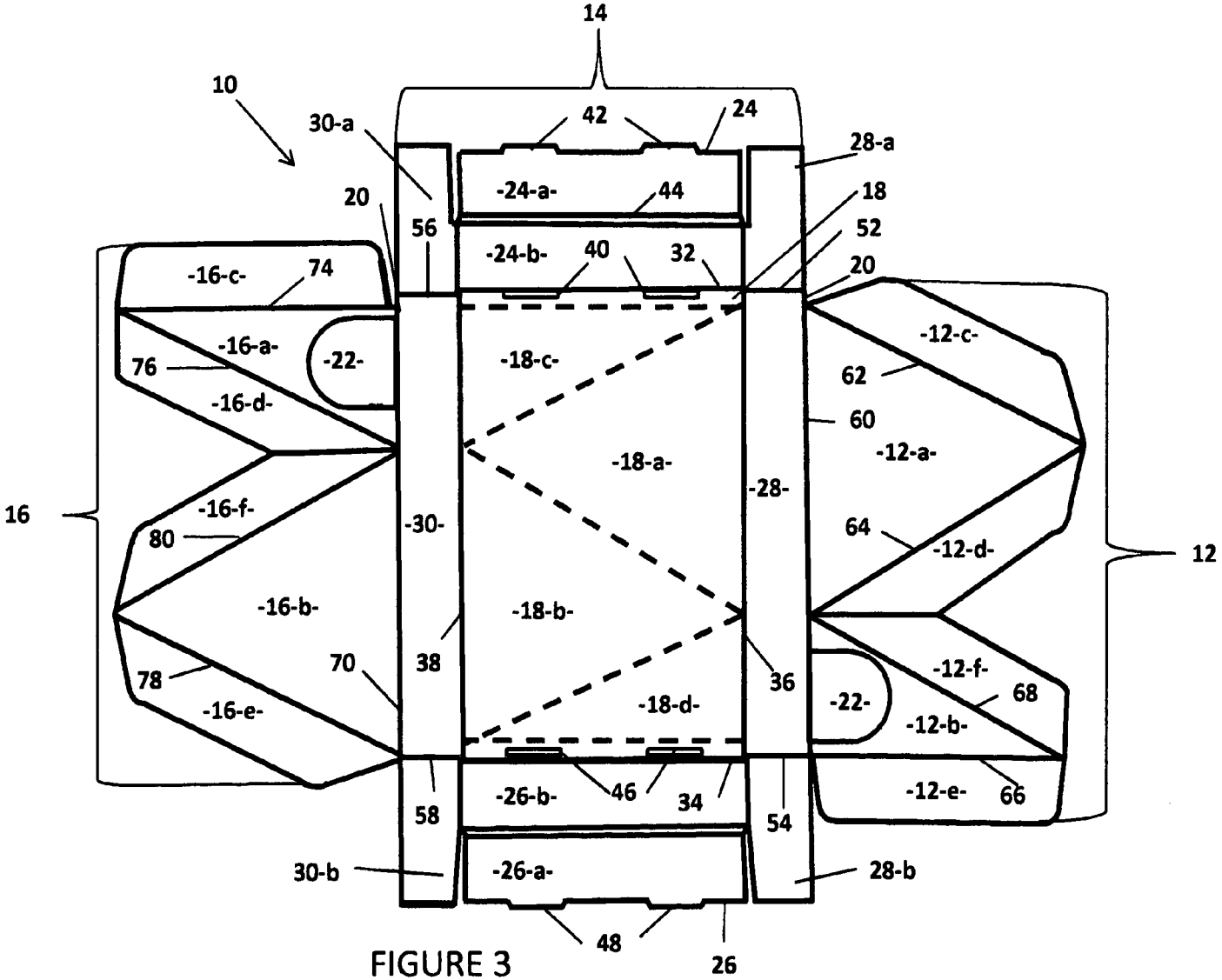
FIG. 3 is a top view of the pizza box with cup holders depicting a second embodiment for the present invention when in an unfolded open position.
Figure 4:
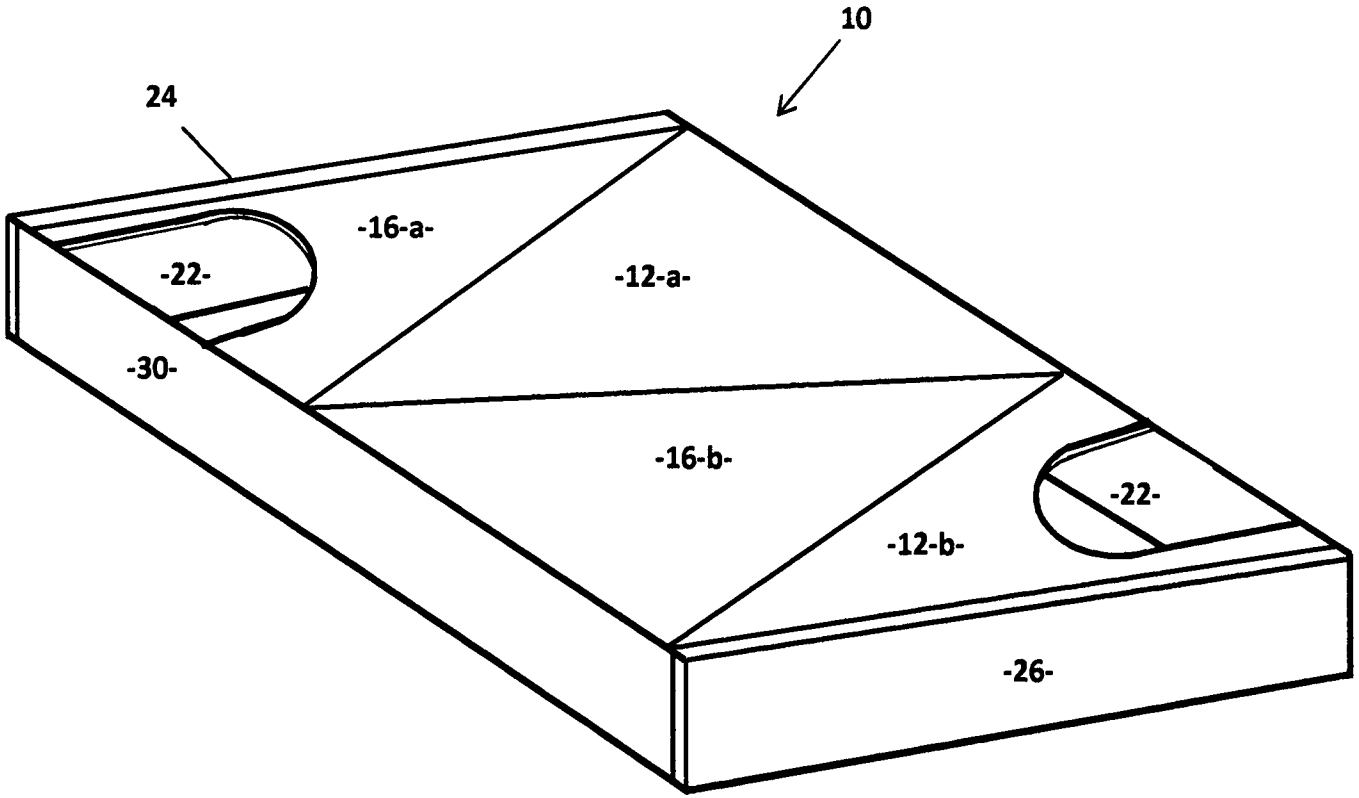
FIG. 4 is a perspective view of the pizza box of FIG. 3 when in a folded closed position.

Referring now to the second embodiment for the present invention depicted in FIGS. 3 & 4. Wherein, the pizza box (10) includes multiple drink cup receptacles (22) and a compartment for containment of multiple single slices of pizza in combination comprising of an integrally made pizza box (10) formed from one piece of material, such as cardboard, Styrofoam™ or any other suitable material of engineering choice. The pizza box (10) having a right side section (12), a central section (14), and a left side section (16). The central section (14) when folded provides a bottom (18) with side walls (20) which form the shape of a box. The bottom (18) including a first sector (18-*a*), a second sector (18-*b*) a third sector (18-*c*) and a fourth sector (18-*d*), (each sector shown in ghost lines). The first sector (18-*a*) functions as a platform for centrally positioning a first single slice of pizza (pizza not shown) onto the bottom (18). The second sector (18-*b*) functions as a platform for centrally positioning a second single slice of pizza onto said bottom.

The right side section (12) having a first half triangular portion (12-*a*) and a second half triangular portion (12-*b*). The first half triangular portion (12-*a*) of the right side section (12) when folded functions as a lid for covering the first sector (18-*a*). The second half triangular portion (12-*b*) of the right side section (12) functions as a lid for covering the fourth sector (18-*d*). The left side section (16) having a first half triangular portion (16-*a*) and a second half triangular portion (16-*b*). The first half triangular portion (16-*a*) of the left side section (16) when folded functions as a lid for covering the third sector (18-*c*) and the second half triangular portion (16-*b*) of the left side section (16) functions as a lid for covering the second sector (18-*b*). The first half triangular portion (12-*a*) of the right side section (12) when folded functions as a lid which is of a shape and size to be positioned above the top and around the sides of the first single slice of pizza, (pizza not shown). The second half triangular portion (12-*b*) of the right side section (12) includes a hole (22) for slideably receiving a first drink cup (not shown) there through. The first sector (18-*a*) functions as a support means for supporting the first drink cup thereon. The first half triangular portion (16-*a*) of the left side section (16) includes a hole (22) for slideably receiving a second drink cup (not shown) there through and the third sector (18-*c*) functions as a support means for supporting the second drink cup thereon.

The central section (14) further includes a first end segment (24), a second end segment (26), a right side segment (28) and a left side segment (30). Each end segment (24 & 26) being opposed to each other yet interconnected by bottom (18). The first end segment (24) being differentiated by a first fold line (32) located between first end segment (24) and the bottom (18). The second end segment (26) being differentiated by a second fold line (34) located between the second end segment (26) and the bottom (18). Each side segment (28 & 30) being opposed to each other yet interconnected by the bottom (18).

The right side segment (28) being differentiated by a third fold line (36) located between the right side segment (28) and the bottom (18). The left side segment (30) being differentiated by a fourth fold line (38) located between the left side segment (30) and the bottom (18). The bottom (18) having a first pair of apertures (40) located adjacent the first fold line (32). The first end segment (24) having a first pair of outwardly projecting tabs (42). The first pair of apertures (40) and the first pair of outwardly projecting tabs (42) being opposed to each other yet interconnected by a first foldable central partition (44) which forms a top half (24-*a*) and a bottom half (24-*b*). The first pair of outwardly projecting tabs (42) being of a shape and size to mate within the first pair of apertures (40) when the first foldable central partition (44) is folded.

The bottom (18) having a second pair of apertures (46) located adjacent the second fold line (34). The second end segment 26) having a second pair of outwardly projecting tabs (48). The second pair of apertures (46) and the second pair of outwardly projecting tabs (48) being opposed to each other yet interconnected by a second foldable central partition (50) which forms a top half (26-*a*) and a bottom half (26-*b*). The second pair of outwardly projecting tabs (48) being of a shape and size to mate within the second pair of apertures (46) when the second foldable central partition (50) is folded.

The right side segment (28) having a right side first end flap (28-*a*) and a right side second end flap (28-*b*) opposed to each other yet interconnected by the right side segment (28). The right side first end flap (28-*a*) being differentiated by a fifth fold line (52) and the right side second end flap (28-*b*) being differentiated by a sixth fold line (54). The left side segment (30) having a left side first end flap (30-*a*) and a left side second end flap (30-*b*) opposed to each other yet interconnected by the left side segment (30) and the left side first end flap (30-*a*) being differentiated by a seventh fold line (56) and the left side second end flap (30-*b*) being differentiated by an eighth fold line (58).

The right side section (12) being interconnected to the right side segment (28) yet differentiated by a ninth fold line (60). The first half triangular portion (12-*a*) of the right side section (12) having an outside elongated flap (12-*c*) differentiated by a tenth fold line (62). The first half triangular portion (12-*a*) of the right side section (12) having an inner elongated flap (12-*d*) differentiated by an eleventh fold line (64). The second half triangular portion (12-*b*) of the right side section (12) has an elongated outside flap (12-*e*) differentiated by a twelfth fold line (66). The second half triangular portion (12-*b*) of the right side section (12) has an elongated inner flap (12-*f*) differentiated by a thirteenth fold line (68). The left side section (16) being interconnected to the left side segment (30) yet differentiated by a fourteenth fold line (70). The first half triangular portion (16-*a*) of the left side section (16) having an outside elongated flap (16-*c*) differentiated by a fifteenth fold line (74). The first half triangular portion (16-*a*) of the left side section (16) having an inner elongated flap (16-*d*) differentiated by a sixteenth fold line (76). The second half triangular portion (16-*b*) of the left side section (16) having an elongated outside flap (16-*e*) differentiated by a seventeenth fold line (78) and the second half triangular portion (16-*b*) having an elongated inner flap (16-*f*) differentiated by a eighteenth fold line (80).

Whereby, when the central section (14) is folded each first end flap (28-*a*) of the right segment (28) and (30-*a*) of the left segment (30) is nested in between the top half (24-*a*) and the bottom half (24-*b*) of the first end segment (24). The second end flap (28-*b*) of the right segment (28) and the second end flap (30-*b*) of the left segment (30) is nested in between the top half (26-*a*) and the bottom half (26-*b*) of the second end segment (26). The first pair of outwardly projecting tabs (42) has a mating relationship within the first pair of apertures (40) and the second pair of outwardly projecting tabs (48) has a mating relationship within the second pair of apertures (46). Thus resulting in central section (14) forming (18) bottom and the side walls (20) of the box (10). The right side section (12) when folded encloses the first sector (18-*a*) and the fourth sector (18-*d*) and when the left side section (16) is folded encloses the third sector (18-*c*) and the second sector (18-*b*).

It can now be seen herein disclosed is a first and a second embodiment for a new and novel pizza box. The first embodiment allows for carrying a single slice of pizza and a beverage in a most convenient manner while the second embodiment allows for carrying a two slices of pizza and two beverages in a most convenient manner. Neither embodiment is taught within the known prior art.

It is to be understood the pizza boxes can be manufactured to be functional for various sized slices of pizza and various sized beverage cups. For example, various sizes may include small, medium, large, extra-large, etc. Thus the invention is not to be limited to a specific size as various sizes are inherent.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. A box having a drink cup receptacle and a compartment for containment of a single slice of pizza in combination comprising: an integrally made box formed from one piece of material, said box having a right side section; a central section and a left side section, said central section when folded provides a bottom with side walls which form said box, said bottom including a first sector; a second sector; and a third sector; said first sector functions as a platform for centrally positioning a single slice of pizza onto said bottom, said right side section when folded functions as a lid which is of a shape and size to be positioned above the top and around the sides of said single slice of pizza, said left side section having a first half triangular portion and a second half triangular portion, said first half triangular portion when folded functions as a lid for covering said third sector, said second half triangular portion functions as a lid for covering said second sector, at least one said half portion includes a hole for slideably receiving a drink cup there through and at least one said sector functions as a support means for supporting said drink cup thereon.

2. The box having a drink cup receptacle and a compartment for containment of a single slice of pizza in combination of claim 1 wherein said one piece of material is cardboard.

3. The box having a drink cup receptacle and a compartment for containment of a single slice of pizza in combination of claim 1 wherein said right side section further includes a perforated finger punch.

4. The box having a drink cup receptacle and a compartment for containment of a single slice of pizza in combination of claim 1 wherein said support means further including at least one or multiple circular indents for supporting different sizes of said drink cup.

5. The box having a drink cup receptacle and a compartment for containment of a single slice of pizza in combination of claim 1 wherein said central section further including a first end segment; a second end segment; a right side segment; and a left side segment; each said end segment being opposed to each other yet interconnected by said bottom, said first end segment being differentiated by a first fold line between said first end segment and said bottom, said second end segment being differentiated by a second fold line between said second end segment and said bottom, each said side segment being opposed to each other yet interconnected by said bottom, said right side segment being differentiated by a third fold line between said right side segment and said bottom, said left side segment being differentiated by a fourth fold line between said left side segment and said bottom, said bottom having a first pair of apertures located adjacent said first fold line, said first end segment having a first pair of outwardly projecting tabs, said first pair of apertures and said first pair of outwardly projecting tabs being opposed to each other yet interconnected by a first foldable central partition which forms a top half and a bottom half, said first pair of outwardly projecting tabs being of a shape and size to mate within said first pair of apertures when said first foldable central partition is folded, said bottom having a second pair of apertures located adjacent said second fold line, said second end segment having a second pair of outwardly projecting tabs, said second pair of apertures and said second pair of outwardly projecting tabs being opposed to each other yet interconnected by a second foldable central partition which forms a top half and a bottom half, said second pair of outwardly projecting tabs being of a shape and size to mate within said second pair of apertures when said second foldable central partition is folded, said right side segment having a right side first end flap and a right side second end flap opposed to each other yet interconnected by said right side segment, said right side first end flap being differentiated by a fifth fold line, said right side second end flap being differentiated by a sixth fold line, said left side segment having a left side first end flap and a left side second end flap opposed to each other yet interconnected by said left side segment, said left side first end flap being differentiated by a seventh fold line, said left side second end flap being differentiated by an eighth fold line, said right side section comprising: a triangular base division: a first elongated flap: and a second elongated flap: said triangular base division being interconnected to said right side segment yet differentiated by a ninth fold line, said first elongated flap being differentiated from said triangular base division by a tenth fold line, said second elongated flap being differentiated from said triangular base division by an eleventh fold line, said left side section being interconnected to said left side segment yet differentiated by a twelfth fold line, said first half triangular portion having an outside elongated flap differentiated by a thirteenth fold line, said first half triangular portion having an inner elongated flap differentiated by a fourteenth fold line, said second half triangular portion having an elongated outside flap differentiated by a fifteenth fold line and said second half triangular portion having an elongated inner flap differentiated by a sixteenth fold line, whereby;

when said central section is folded each said first end flap of said right segment and said left segment is nested in between said top half and said bottom half of said first end segment, said second end flap of said right segment and said left segment is nested in between said top half and said bottom half of said second end segment, said first pair of outwardly projecting tabs have a mating relationship within said first pair of apertures and said second pair of outwardly projecting tabs have a mating relationship within said second pair of apertures, thus resulting in said central section forming said bottom and said side walls of said box, said right side section when folded encloses said first sector, when said first half portion is folded encloses said third sector and said second half portion when folded encloses said second sector.

6. A box having multiple drink cup receptacles and a compartment for containment of multiple single slices of pizza in combination comprising: an integrally made box formed from one piece of material, said box having a right side section; a central section and a left side section, said central section when folded provides a bottom with side walls which form said box, said bottom including a first sector; a second sector; a third sector and a fourth sector; said first sector functions as a platform for centrally positioning a first single slice of pizza onto said bottom, said second sector functions as a platform for centrally positioning a second single slice of pizza onto said bottom, said right side section having a first half triangular portion and a second half triangular portion, said first half triangular portion when folded functions as a lid for covering said first sector, said second half triangular portion functions as a lid for covering said fourth sector, said left side section having a first half triangular portion and a second half triangular portion, said first half triangular portion when folded functions as a lid for covering said third sector, said second half triangular portion functions as a lid for covering said second sector, said first half triangular portion of said right side section when folded functions as a lid which is of a shape and size to be positioned above the top and around sides of said first single slice of pizza, said second half triangular portion of said right side section includes a hole for slideably receiving a first drink cup there through, said first sector functions as a support means for supporting said first drink cup thereon, said first half triangular portion of said left side section includes a hole for slideably receiving a second drink cup there through and said third sector functions as a support means for supporting said second drink cup thereon.

7. The box having multiple drink cup receptacles and a compartment for containment of multiple single slices of pizza of claim 6 wherein said one piece of material is cardboard.

8. The box having multiple drink cup receptacles and a compartment for containment of multiple single slices of pizza of claim 6 wherein said central section further including a first end segment; a second end segment; a right side segment; and a left side segment; each said end segment being opposed to each other yet interconnected by said bottom, said first end segment being differentiated by a first fold line between said first end segment and said bottom, said second end segment being differentiated by a second fold line between said second end segment and said bottom, each said side segment being opposed to each other yet interconnected by said bottom, said right side segment being differentiated by a third fold line between said right side segment and said bottom, said left side segment being differentiated by a fourth fold line between said left side segment and said bottom, said bottom having a first pair of apertures located adjacent said first fold line, said first end segment having a first pair of outwardly projecting tabs, said first pair of apertures and said first pair of outwardly projecting tabs being opposed to each other yet interconnected by a first foldable central partition which forms a top half and a bottom half, said first pair of outwardly projecting tabs being of a shape and size to mate within said first pair of apertures when said first foldable central partition is folded, said bottom having a second pair of apertures located adjacent said second fold line, said second end segment having a second pair of outwardly projecting tabs, said second pair of apertures and said second pair of outwardly projecting tabs being opposed to each other yet interconnected by a second foldable central partition which forms a top half and a bottom half, said second pair of outwardly projecting tabs being of a shape and size to mate within said second pair of apertures when said second foldable central partition is folded, said right side segment having a right side first end flap and a right side second end flap opposed to each other yet interconnected by said right side segment, said right side first end flap being differentiated by a fifth fold line, said right side second end flap being differentiated by a sixth fold line, said left side segment having a left side first end flap and a left side second end flap opposed to each other yet interconnected by said left side segment, said left side first end flap being differentiated by a seventh fold line, said left side second end flap being differentiated by an eighth fold line, said right side section being interconnected to said right side segment yet differentiated by a ninth fold line, said first half triangular portion of said right side section having an outside elongated flap differentiated by a tenth fold line, said first half triangular portion having an inner elongated flap differentiated by an eleventh fold line, said second half triangular portion of said right side section having an elongated outside flap differentiated by a twelfth fold line, said second half triangular portion of said right side section having an elongated inner flap differentiated by a thirteenth fold line, said left side section being interconnected to said left side segment yet differentiated by a fourteenth fold line, said first half triangular portion of said left side section having an outside elongated flap differentiated by a fifteenth fold line, said first half triangular portion of said left side section having an inner elongated flap differentiated by a sixteenth fold line, said second half triangular portion of said left side section having an elongated outside flap differentiated by a seventeenth fold line and said second half triangular portion having an elongated inner flap differentiated by a eighteenth fold line, whereby;

when said central section is folded each said first end flap of said right segment and said left segment is nested in between said top half and said bottom half of said first end segment, said second end flap of said right segment and said left segment is nested in between said top half and said bottom half of said second end segment, said first pair of outwardly projecting tabs have a mating relationship within said first pair of apertures and said second pair of outwardly projecting tabs have a mating relationship within said second pair of apertures, thus resulting in said central section forming said bottom and said side walls of said box, said right side section when folded encloses said first sector and said fourth sector, when said left side section is folded encloses said third sector and said second sector.

* * * * *